United States Patent [19]

Rewitzer

[11] Patent Number: 4,687,462

[45] Date of Patent: Aug. 18, 1987

[54] PROCESS FOR THE AUTOMATIC INSERTION OF BOX-SHAPED BAGS

[75] Inventor: Siegfried Rewitzer, Ihrlerstein, Fed. Rep. of Germany

[73] Assignee: Hoechst Aktiengesellschaft, Fed. Rep. of Germany

[21] Appl. No.: 798,235

[22] Filed: Nov. 14, 1985

Related U.S. Application Data

[63] Continuation of Ser. No. 459,356, Jan. 20, 1983, abandoned.

[30] Foreign Application Priority Data

Jan. 30, 1982 [DE] Fed. Rep. of Germany ..... 3203071

[51] Int. Cl.[4] ..... B31B 7/00

[52] U.S. Cl. ..... 493/100; 493/93; 493/95; 493/907; 493/363; 53/175; 53/374

[58] Field of Search ..... 493/93, 100, 95, 217, 493/294, 907, 922, 363, 372, 356, 194; 53/374, 372, 175

[56] References Cited

U.S. PATENT DOCUMENTS

| | | | |
|---|---|---|---|
| 2,350,418 | 6/1944 | Ross | 53/374 |
| 4,089,255 | 5/1978 | Akoh et al. | 493/100 |
| 4,230,030 | 10/1980 | Hansen et al. | 493/194 |
| 4,330,289 | 5/1982 | Christensson | 493/100 |

*Primary Examiner*—Robert L. Spruill
*Assistant Examiner*—David B. Jones
*Attorney, Agent, or Firm*—Connolly and Hutz

[57] ABSTRACT

The invention relates to process and apparatus for the automatic insertion of prefabricated box-shaped bags made of flexible packaging material into large box-shaped containers with a capacity of more than 100 liters. The bags are suspended on rolling carriages in such a way that two opposing sides are extended at the bag edge, the rolling carriage equipped in this way is transported to a transfer point where one side of the bag is received by a pulling device, and as a result of movement of the pulling device the bag is extended fully at its upper edge. Subsequently, the bag is received by a spreading device and introduced by way of the spreading device into a large container. The edges at the upper margin of the bag may be cut to form marginal side flaps for transfer into appropriate retaining devices on the large container.

2 Claims, 12 Drawing Figures

PROCESS FOR THE AUTOMATIC INSERTION OF BOX-SHAPED BAGS

CROSS REFERENCE TO RELATED APPLICATION

The present application is a continuation of application Ser. No. 459,356, filed Jan. 20, 1983, now abandoned.

The invention relates to processes for the automatic insertion of box-shaped bags made of flexible packaging material into large box-shaped containers.

It is known to decant pourable goods into box-shaped containers made, for example, of paperboard or metals. To protect the packaged goods, protective sheathing with a plastic material is conventionally carried out, in addition, for example in the case of a cardboard packaging. This additional sheathing made of a flexible packaging material is generally applied on the outside of the box-shaped receptacles, and only in special cases by introducing bags made of flexible packaging material, which have either round or square cross-section. Packaging forms of this type are used especially when the goods to be packaged are not allowed to come in contact with the shaping material of the packaging container used. For the insertion of bags of this type into small containers which are suitable for gram to kilogram quantities, a series of automatically operating packaging machines have been designed, which make it possible to produce automatically a large number of packaging containers of this type with inserted bags made of flexible packaging material. Apparatuses of this type are very expensive because of their high throughput capacity per unit time. It is also not possible for technical reasons to use them when large box-shaped bags made of flexible packaging material are inserted in large box-shaped containers. By large box-shaped containers are meant, here, those having a packaging volume of more than 100, preferably more than 200, liters. A preferred field of use of large box-shaped containers of this type is, for example, in the depositing and compressing of fiber tows, as described in U.S. Pat. No. 4,224,780. In the process according to the previously published literature mentioned, it is necessary to insert box-shaped bags made of flexible packaging material into metallic supporting containers of the same size. Fiber tows can be deposited and prepressed in the supporting containers equipped in this way. After the filled supporting container has been transported to a final press, the supporting container is drawn off and the tow material prepressed in the box-shaped bag subsequently undergoes final pressing in bale form. Large containers are also suitable for the packaging of tows and staple fiber, and to protect the packaged material against impurities on the container walls the containers have to be lined with box-shaped bags made of flexible packaging material.

An automatically operating insertion apparatus and a suitable automatically operating process have hitherto not been proposed for fields of use of this type. Conventionally, the ready-made box-shaped bags are introduced into these large containers by hand and are extended in the containers if appropriate by the use of the simplest mechanical aids. However, processes of this type are very labor-intensive and impede known packaging processes which conventionally take place completely continuously. For example, when an apparatus for pressing and packaging fiber tows is used, it is necessary to line the supporting containers with box-shaped bags in uninterrupted continuous operation even on the late shift and night shift.

There was therefore still the need to find a process and a suitable apparatus which make it possible to insert large box-shaped bags made of flexible packaging material into large box-shaped containers and in which the individual working steps no longer have to be carried out by hand, but can take place fully automatically one after the other.

It is an object of the present invention to provide a reliable and trouble-free process for the automatic insertion of prefabricated flexible bags into large box-shaped containers.

Another object of the invention is a process and apparatus for the insertion of box-shaped flexible bags into large box-shaped containers which is easy to follow and effective in use.

Novel features and advantages of the present invention in addition to those mentioned above will become apparent to those skilled in the art from a reading of the following detailed description in conjunction with the accompanying drawing wherein FIG. 1 is a diagrammatic side elevational view of the bag carriages and magazine track of a bag insertion apparatus, according to the present invention;

The process according to the invention is aimed at insertion, to be carried out automatically, of box-shaped bags made of flexible packaging material into large box-shaped containers. Here, for example, appropriate linings made of foils, jute fabrics or the like can be used as flexible packaging material. The use of plastic foil laminated with a plastic film tape fabric has proved especially appropriate for many purposes, since such material can easily be cut to size and sewn, glued or welded into box-shaped bags, but on the other hand has a substantially greater tear propagation resistance than conventional foils.

Figure 1:
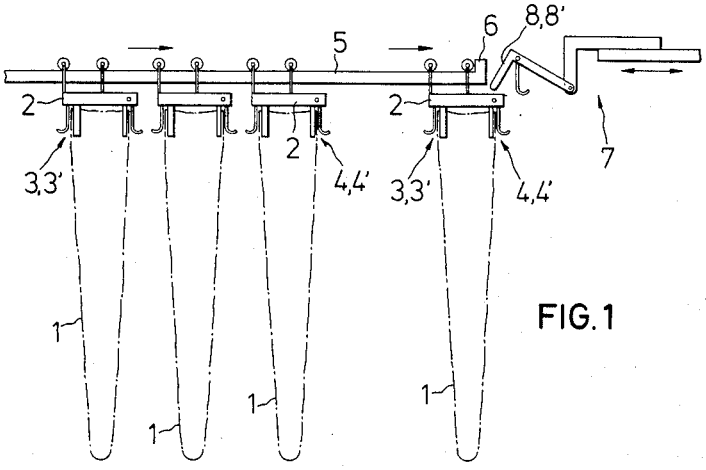
Figure 2:
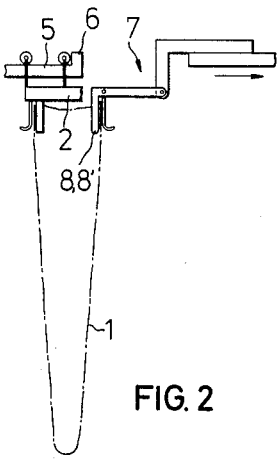
FIG. 2 is a view similar to FIG. 1 showing the pulling device of the apparatus just prior to opening the bag.
Figure 3:
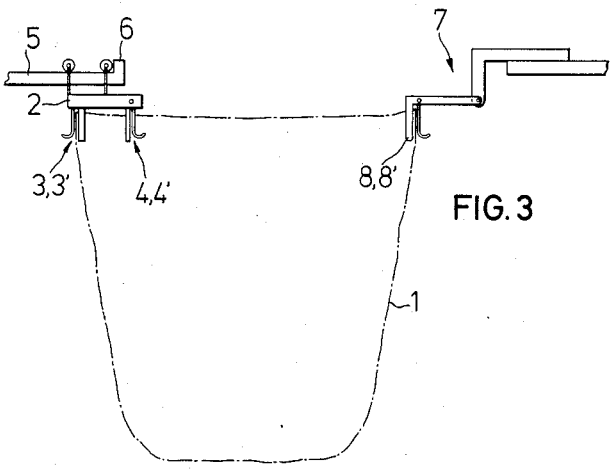
FIG. 3 is a view similar to FIG. 2 showing the top of the bag in its fully open position.

Prefabricated box-shaped bags (1) first have to be introduced into the apparatus. This purpose is served by rolling carriages (2) which are provided with at least four clamping points (3, 3', 4, 4'). These clamping points must be located in pairs so far apart from one another that two opposing side faces of a bag can be clamped extended at the upper margin, whilst the other two side faces and the bottom of the bag remain folded together. FIG. 1 shows rolling carriages (2) of this type, equipped with box-shaped bags (1). Here, the rolling carriages (2) are stored on a first magazine track (5) and are brought up against a stop (6) by means of a pushing device which is not shown. From the opposite side of the stop (6), a pulling device (7) is then extended, and this is equipped at least with two grippers (8, 8') which are approximately as far away from one another as a side face of the bag is wide. The grippers (8, 8') can be actuated, for example, via a small servo motor with a lever system or else via a pneumatic drive (not shown). The grippers (8, 8') can be lifted over the margin of the next side face of the box-shaped bag (1) and then lowered to the height of the bag margin, this side face being clamped resiliently in the grippers (8, 8'). The pulling device (7), together with the grippers (8, 8'), is subsequently retracted. At the same time, the clamp-connection of the clamping points (4, 4') on this side of the bag (1) is drawn out from the rolling carriage (2) and, as illustrated in FIGS. 1 to 3, the bag is extended at least at its upper end.

Figure 4:
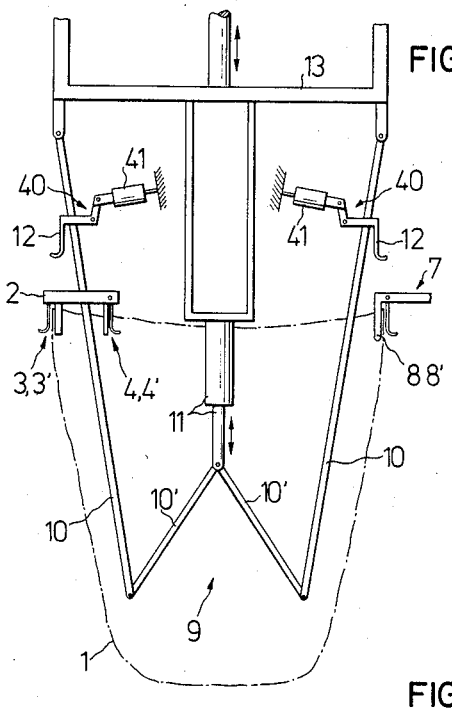
FIG. 4 is a view similar to FIG. 3 with the bag spreading device of the apparatus entering the bag.

Subsequently, a spreading device (9), the spreading elements (10, 10') of which are folded in, is introduced into the opened bag, and the spreading elements (10, 10') are then extended, the bag being tensioned. FIG. 4 illustrates this introduction of the spreading device (9) in the folded-in state. The spreading elements are appropriately designed as a quadruple lever-frame system which can be moved, for example, by a pneumatic drive system (11). During this time, the spreading elements (10) are aligned along the four longitudinal edges of the box-shaped bag. As a result of the extension of the spreading device (9), the bag is extended completely and tensioned between the spreading elements (10, 10'), so that it is now no longer possible for the bag to fall off, at all events in the tensioned state of the spreading device (9).

The bag edge is released from the clamping points (3, 3') on the rolling carriage (2) and from the resilient grippers (8, 8') of the pulling device (7) as a result of simple further lowering of the spreading deVice (9) beyond the transfer point.

Figure 5:
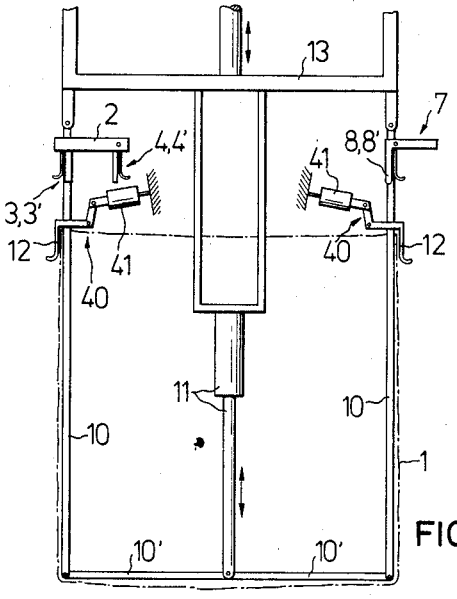
FIG. 5 is a view similar to FIG. 4 with the bag fully spread open.

Located on the individual spreading elements (10) of the spreading device (9), in the vicinity of the edges of the bag, are actuable clamps (12) which are actuated by the spreading device at the latest after the tensioned bag has been finally received. The actuable clamps (12) are located at such a height that they can retain at its upper margin the bag (1) tensioned on the spreading device (9), after the bag has been tensioned and pulled smooth. After the clamps (12) have been actuated, the spreading device (9) can be retracted, that is to say folded together. The tensioned state of the bag after its removal from the clamping points (3, 3') and from the resilient grippers (8, 8') of the pulling device (7) is illustrated in FIG. 5, whilst the state of the bag and of the spreading device after the spreading device (9) has been folded in may be seen in FIG. 6. In this state, the spreading device can be moved by means of a moving device (13) into a large box-shaped container (14) and can be lowered there.

Figure 6:
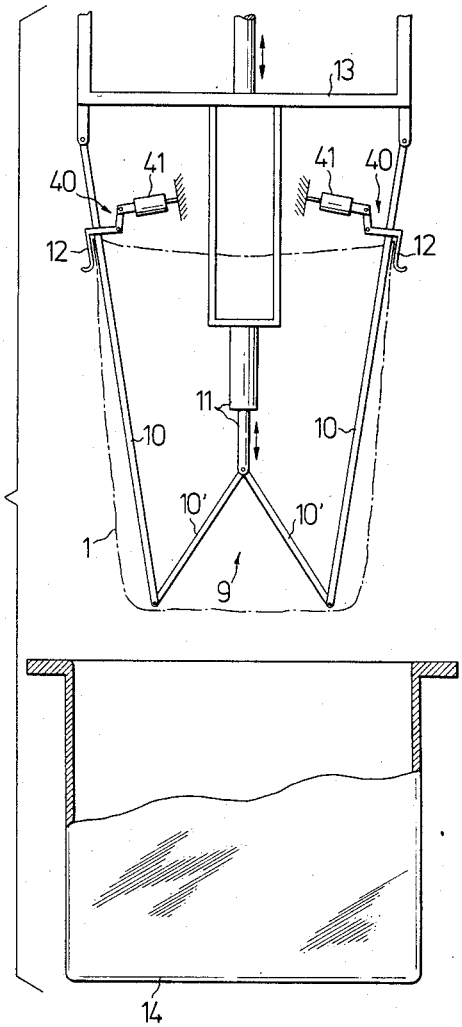
FIG. 6 is a view similar to FIG. 5 illustrating the bag and the spreader device in a partially collapsed position about to enter the container.
Figures 11, 12:
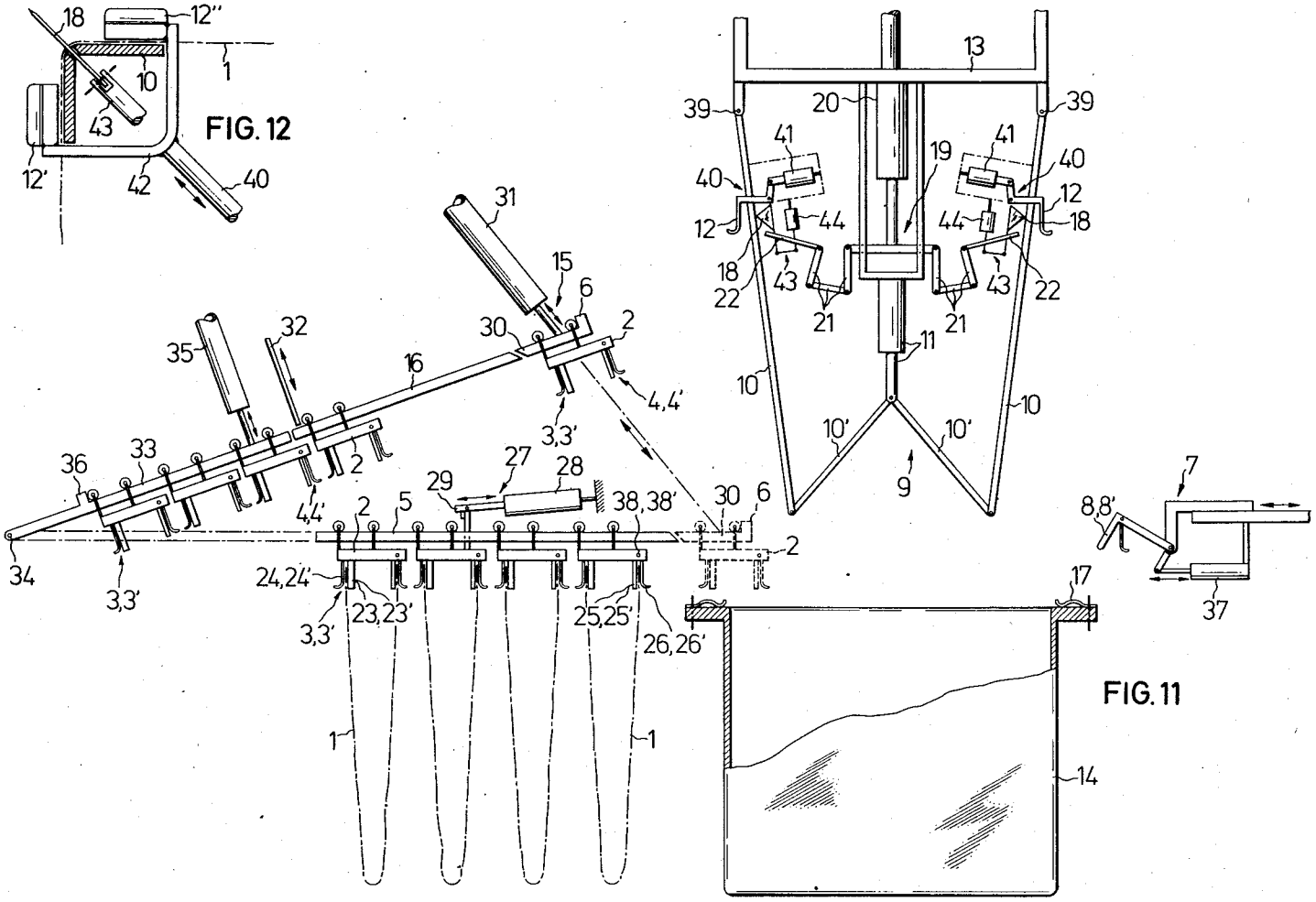
FIG. 11 is a diagrammatic side elevational view of the overall apparatus of the present invention for the automatic insertion of box-shaped bags.
FIG. 12 is a fragmental top plan view of one of the corner knives for partially slitting the bag as also shown in FIG. 7.

In FIG. 6, the rolling carriage (2) and the pulling device (7) together with the grippers (8, 8') can no longer be seen. The rolling carriage has been lifted by means of a lifting device (15) onto a second magazine track (16) on which the rolling carriage (2) can be guided back onto the first magazine track (5). The details of the arrangement of the lifting device (15) and of the second magazine track (16) will be discussed later in connection with the apparatus; they are shown in FIG. 11.

The pulling device (7) has been removed from the effective range of the spreading frame (9) and consequently from the vicinity of the tensioned bag (1) as a result of retraction by means of a moving device (not shown).

After the spreading device (9) equipped with the box-shaped bag (1) has been lowered into the large container (14) to be equipped, the spreading device (9) is extended slowly, the box-shaped bag being laid over its full surface against the container walls. It is possible to fix the position of the box-shaped bag (1) in the large container (14) in various ways. For example, the inner wall of the large container (14) can have suction or adhesive places which make it possible to fix the position of the bag in the large container (14). Preferred embodiments of the fixing of the position of the box-shaped bag (1) in the large container will be described below. When the position of the bag has been ensured by one of these measures, the clamps (12) can be released, the spreading device (9) folded in and the entire spreading device retracted from the large container (14). The large container is then equipped on its inner faces with the box-shaped bag (1) of appropriate size.

FIGS. 7 to 12 illustrate preferred embodiments of the process according to the invention and of the apparatus required for this.

In these preferred alternative forms of the process, the upper margin of the box-shaped bag is incised over a length (a) and the foldable strips obtained at the upper margin of the box-shaped bag (1) are connected to retaining devices (17) at the upper margin of the large container. For this purpose, it is necessary for the box-shaped bag (1) to be retained at the upper ends of the longitudinal edges by two clamps (12', 12'') in each case which are located in the vicinity of the bag edge. A corresponding diagrammatic representation is illustrated in a plan view in FIG. 12. Between the two clamps (12', 12'') of each edge of the box-shaped bag there acts an actuable knife (18) which can be pivoted in and out by a moving device (not shown). As a result of the knives being pivoted out in the edge of the box-shaped bag (1), the edges of the box-shaped bag are cut over a predetermined length (a) (FIG. 7).

After the upper edges of the box-shaped bag (1) have been cut by the knives (18), the spreading device (9) is generally folded in, the box-shaped bag (1) is then lowered into a large container with the aid of the spreading device (9) and the spreading device (9) is tensioned in the container (14). After the clamps (12) or (12', 12'') have been released, foldable margins of the box-shaped bag (1) are now available which can be connected to the upper edge of the large container (14). This connection which at the same time results in fixing of the position of the box-shaped bag in the large container (14), can be made, for example, by gluing on, the action of suction heads, stitching on or clamping on.

Figure 7:
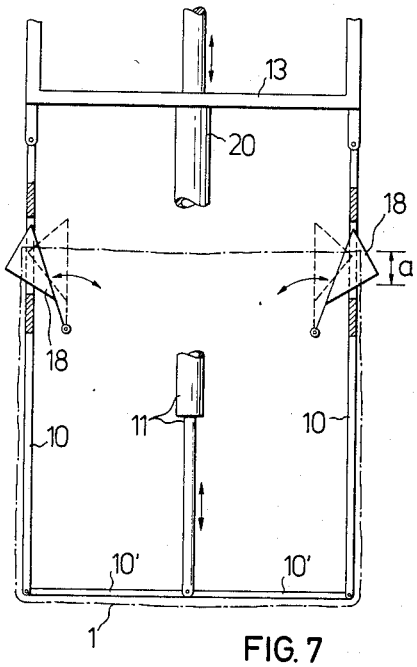
FIG. 7 is a diagrammatic side elevational view illustrating corner knives for partially slitting each of the four corners of the bag to thereby form marginal side flaps.
Figure 8:
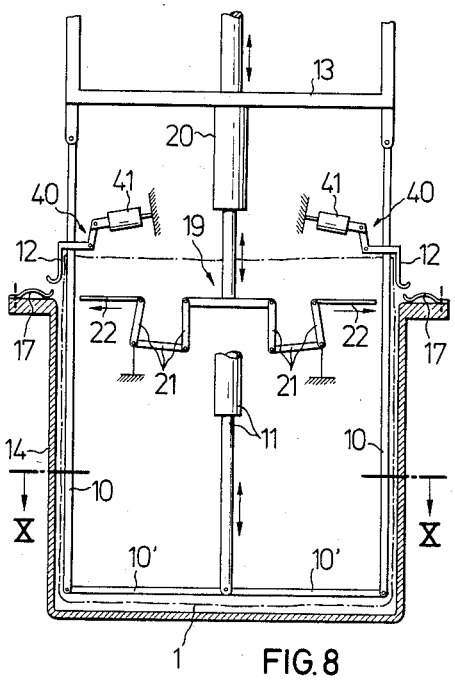
FIG. 8 is a diagrammatic side elevational view of a mechanism for pushing the side flaps of the bags outwardly of the container.

FIG. 7 illustrates diagrammatically the mode of action of the knives (18), whilst FIG. 8 illustrates a preferred form of fixing the position of the box-shaped bag (1) in the large container (14). Here, the upper edges of the bag (1), which have become freely movable as a result of the action of the knives (18), are pushed by means of a transfer device (19) into the resiliently acting retaining devices (17) of the large container (14). According to FIG. 8, the transfer device (19) consists of a pneumatic drive (20), the piston rod of which sets in motion lever systems (21) which change the position of sword-like plates (22). Only two of the lever systems and transfer swords (22), of which there are four in all, are shown in FIG. 8. The transfer takes place in such a way that when the pneumatic drive (20) is extended the sword-like transfer drives (22) act on the upper margin of the bag (1).

Figure 9:
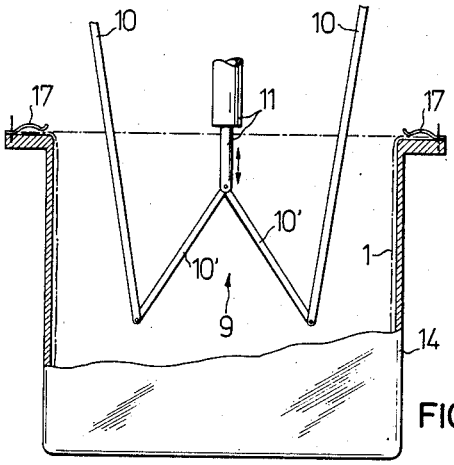
FIG. 9 is a view similar to FIG. 8 illustrating the marginal side flaps retained on the container and the spreader device being removed.

After the clamps (12) or (12', 12") have been released, it is possible to push the upper margin, incised in the edges, of the box-shaped bag (1) under the retaining devices (17) of the large container (14). In FIG. 9, the transfer of the box-shaped bag to the retaining device (17) has been carried out, and the spreading device is retracted and is removed from the interior of the large container by means of the moving device (13). The large container is now ready prepared for the packaging, and it can be used, for example according to the process of German Offenlegungsschrift No. 2,736,316, for the depositing of fiber tows.

Figure 10:
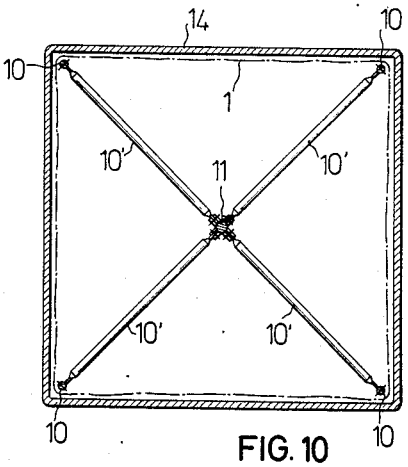
FIG. 10 is a cross-sectional view taken along line X—X of FIG. 8.

FIG. 10 shows a cross-section along the line X—X in FIG. 8. It is evident from this Figure that the spreading frames (10) each fit into the edges of the box-shaped bag and of the large container. It is therefore possible to insert the box-shaped bag (1), substantially free of creases, into the large container (14).

An embodiment of the apparatus required according to the invention is illustrated diagrammatically in FIG. 11. The box-shaped bags (1) being used are introduced into the clamps (3, 3', 4, 4') of the rolling carriages (2). These rolling carriages (2) are guided on a first magazine track (5). The clamps (3, 3') and (4, 4') are in each case located so far apart from one another that at least one side of the box-shaped bag (1) can be clamped extended between them. The clamping points (3 and 3') consist, here, of a fixed part (23, 23') connected rigidly to the linkage of the rolling carriage (2) and of a resilient part (24, 24') which makes it possible to clamp packaging material. The clamping points (4, 4') are designed in a similar way. In contrast to the fixed parts (23, 23'), however, the fixed parts (25, 25') are movable about the centers of rotation (38, 38'), and the resilient parts (26, 26') correspond to the springs (24, 24').

It must be possible for the rolling carriages (2) to be moved to and fro easily on the magazine track (5), and this can be effected, for example, via rollers or sliding pieces or the like. The form of the magazine track can be that of an open rail track. For example, the use of so-called C-rails for guiding the rollers of the carriage (2) has proved appropriate.

The advance of the rolling carriages (2) is carried out via a pushing device (27) which has a drive (28) moving to and fro. The movement of the rolling cariages (2) on the first magazine track (5) occurs as a result of actuation of the drive (28), to which is connected a ratchet (29) which can interact with the rolling carriages (2). As a result of actuation of the pushing device (27), the rolling carriages (2) are transported on the magazine track (5) until the first carriage reaches the stop (6) of the first magazine track (5).

After the bag (1) has been transferred to the spreading device (9), the now empty rolling carriage (2) must be lifted onto a second magazine track (16). This can be carried out, for example, by means of a lifting device (15) which can lift the end piece (30) of the magazine track (5), including the stop (6), up to the height of the second magazine track (16). A pneumatic drive (31) serves, again, as a drive for the lifting device (15). The empty rolling carriage (2) then runs further on the inclined magazine track (16) up to an actuable stop (32), if no further empty rolling carriages (2) are located on the magazine track (16). The connection between the first magazine track (5) and the second magazine track (6) is made by means of a movable track part (33) which can be pivoted about the pivot pin (34) by means of a moving device (35). When the part (33) is lifted and the stop (32) is opened, the empty rolling carriages can roll further up to a stop (36). After the stop (32) has closed, the track part (33) can be lowered to the height of the first magazine track (5), and the rolling carriages (2) can be transferred from the movable track part (33) onto the first magazine track (5).

The pulling device (7) is indicated as being located opposite the stop (6) and can be pushed forward by means of a device (not shown) with its gripper arms (8, 8') into the vicinity of the stop (6). The grippers (8, 8') are actuated via an actuating member (37). When the piston of the actuating member (37) is extended, the gripper arms (8, 8') pivot upwards and can thus be lifted over the first bag edge of the bag which is located in the rolling carriage standing against the stop (6). After the gripper device (8, 8') has been lowered, the bag edge is retained resiliently by the grippers.

When the pulling device (7), together with the closed grippers (8, 8'), is retracted, the gripped bag can be pulled out of the clamping points (4, 4') of the rolling carriage, without the clamping in the grippers (8, 8') being changed. At the same time, the clamping points (4, 4') pivot about their pivot pins (38, 38'). The grippers (8, 8') will also retain extended one side of the clamped bag (1), and it is therefore necessary for the grippers (8, 8') to be located almost as far apart from one another as one side of the box-shaped bag is wide.

So that the bag extended between the clamping points (3, 3') and the grippers (8, 8') can be transferred into a large container (14), it is necessary to transfer the extended bag to a spreading device (9). This spreading device (9) preferably consists of four spreading elements (10, 10') which can be moved via a drive system (11). The spreading device (9) is fastened to a moving device (13) which allows movement of the spreading device (9) at least in a vertical direction, but, if appropriate, also additionally in a horizontal direction. The spreading elements (10) are fastened to the moving device (13) movably via axle pins (39) and on their lower side are connected movably to spreading elements (10') which are connected movably to the piston of the drive (11). As a result of movement of the drive (11), the position of the spreading elements (10) can be changed. The position of the spreading elements (10) in the retracted state is evident from FIG. 4, and in FIG. 5, with the piston rod of the drive (11) extended, the position of the spreading elements (10 and 10') in the tensioned state. The four spreading elements (10) act along the edges of the box-shaped bag, as was illustrated in the diagrammatic plan view of FIG. 10. In FIG. 10, the spreading elements (10, 10') have a circular cross-section. However, the cross-section of these elements does not need to be circular, and, for example in FIG. 12, a spreading element (10) produced from an angular profile is shown.

Actuable clamps (12) are attached to the spreading elements (10). Actuation takes place via a lever system (40) by means of a drive (41) which has been illustrated, again, as a pneumatic drive in FIG. 11.

In a preferred embodiment of the apparatus according to the invention, the bag margin is retained in the vicinity of each edge of the bag (1) by two actuable clamps (12', 12'') which are connected to the lever system (40) via an angle piece (42). A design of this type is illustrated as a cut-out in FIG. 12. The actuable clamps (12) or (12', 12'') are attached to the spreading elements (10) at such a height that they can just clamp the upper edge of the bag (1). To ensure that the bag is retained in the clamps (12) or (12', 12'') even during movement of the spreading device (9), it is apropriate to connect the drives (41) and the fixed points of the lever system (40) to the spreading elements (10). Otherwise, there is a danger that when the spreading device (9) is folded in the clamping property of the clamps (12) could be cancelled. It is necessary, furthermore, for the spreading elements (10) to be longer than the height of the bags used. Only in this way is it possible that, when the spreading device is introduced, the subsequent introduction of the box-shaped bag tensioned in the spreading device (9) into the large container (14) be carried out without difficulties.

In a preferred embodiment of the apparatus according to the invention, actuable knives (18) are provided on each spreading element (10) at the height of the upper edge of the clamped bag. FIG. 12 shows an exact arrangement; here, the knife (18) acts directly through a slit in the spreading element (10). The knives (18) also are connected to drives (44) via lever systems (43). These drives ensure via the lever systems that the knives (18) can be pivoted out and the bag incised at its upper margin in each of its edges over a predetermined length.

In FIG. 11, there is also a transfer system (19) which consists of a drive (20) and lever systems (21) connected to this as well as of swords (22) which can be pivoted out. For the sake of clarity, FIG. 11 shows only two of these lever systems and two of the swords which can act on the upper bag edge. The swords (22) are elongate ruler-like structures which allow the foil material to be transferred under the retaining devices (17) of the large container (14).

In FIG. 11, the large container (14) has retaining devices in the form of long leaf springs (17) at its upper margin, these being capable of retaining resiliently the incised edge of the box-shaped bag (1). For the purpose of transferring or receiving the box-shaped bag (1), the large container (14) can be conveyed to the exact place of transfer by a moving device (not shown), such as, for example, a roller conveyor or the like. This exact place can be fixed, for example, by suitable stops or the like. It is not absolutely necessary for this transfer place to be located within the actual apparatus, as shown in FIG. 11, that is to say between the rail track (5) and the pulling device (7) and underneath the spreading device (7) and underneath the spreading device (9). It would also be possible to put a transfer place in another location. In this case, it would only be necessary to ensure that the moving device (13) of the spreading device (9) can execute appropriate movements at another transfer place.

The apparatus shown and described has a series of drives. In the Figures, they are mostly illustrated as moving devices operated pneumatically. Since they usually have to execute only a to-and-fro movement, such a type of drive would seem to be especially simple and least susceptible to faults. It is possible, however, also to execute these movements, for example, by means of electric servo motors, for example in conjunction with gears or toothed chains or the like.

For reasons of simplification, there is no representation of the pneumatic control lines for the drives or illustration of the control system required. Control systems of this type are known in principle. They can be preset or programmed directly according to the parameters provided for the process. The same applies to measuring devices, such as, for example, light barriers or the like, which have to ensure the progress of the process and perfect actuation of the apparatus.

What is claimed:

1. A process for the automatic insertion of box-shaped bags made of flexible packaging material into large box-shaped containers for depositing and compressing of fiber tow or staple fibers, each container having side walls and a generally flat bottom wall, the process comprising the steps of suspending a box-shaped bag in a generally vertical position with two opposing side faces extended and the other two side faces and bottom of the bag folded together, storing a plurality of such suspended bags next to one another, transporting each suspended bag to a bag transfer station, partially opening the bag at the transfer station, positioning a bag spreading device inside the partially open bag, taking the bag on the spreading device and inserting the partially open bag with the bag spreading device therein into a container, spreading the side faces of the bag open into engagement with the inside of the side walls and flat bottom wall of the container, resiliently retaining the bag within the container and thereafter collapsing and then removing the spreader device to thereby transfer the bag to the container, and partially cutting each corner of the bag at the top bottom thereof to thereby form marginal side flaps at the top of the bag.

2. A process as in claim 1 including the further step of outwardly urging each of the marginal side flap to a substantially horizontal position where the flaps cooperate with the top of the container.

* * * * *